US006922926B2

(12) United States Patent
Miller et al.

(10) Patent No.: US 6,922,926 B2
(45) Date of Patent: Aug. 2, 2005

(54) UNIVERSAL COUPLER FOR EXCAVATOR BUCKETS

(75) Inventors: Gary Miller, Washington (GB); Ronald Keith Miller, Newcastle (GB); Paul Maguire, Winlaton (GB)

(73) Assignee: Miller UK Limited, Northumberland (GB)

( * ) Notice: Subject to any disclaimer, the term of this patent is extended or adjusted under 35 U.S.C. 154(b) by 295 days.

(21) Appl. No.: 10/203,332

(22) PCT Filed: Feb. 9, 2001

(86) PCT No.: PCT/GB01/00524

§ 371 (c)(1),
(2), (4) Date: Feb. 24, 2003

(87) PCT Pub. No.: WO01/59222

PCT Pub. Date: Aug. 16, 2001

(65) Prior Publication Data

US 2003/0154636 A1 Aug. 21, 2003

(30) Foreign Application Priority Data

Feb. 11, 2000 (GB) ..... 0003267

(51) Int. Cl.[7] ..... E02F 3/96
(52) U.S. Cl. ..... 37/468; 414/723; 403/322.3
(58) Field of Search ..... 37/468, 403; 414/723; 403/325, 322.3, 321, 300, 329, 326, 330

(56) References Cited

U.S. PATENT DOCUMENTS 4,871,292 A * 10/1989 Milanowski ..... 414/723
5,082,389 A 1/1992 Balemi
5,147,173 A * 9/1992 Fauber et al. ..... 414/723
5,179,794 A * 1/1993 Ballinger ..... 37/468
5,332,353 A * 7/1994 Arnold ..... 414/723
5,584,644 A * 12/1996 Droegemueller ..... 414/723
6,163,989 A * 12/2000 Kaczmarski et al. ..... 37/468
6,233,852 B1 * 5/2001 Pemberton ..... 37/468
6,254,331 B1 * 7/2001 Pisco et al. ..... 414/723
6,312,212 B1 * 11/2001 Burlew, Jr. ..... 414/723
6,422,805 B1 * 7/2002 Miller ..... 414/723
6,481,124 B1 * 11/2002 Miller et al. ..... 37/468
6,487,800 B1 * 12/2002 Evans et al. ..... 37/468

FOREIGN PATENT DOCUMENTS

| | | |
|---|---|---|
| EP | 0 405 813 A2 | 1/1991 |
| EP | 0 769 590 A2 | 4/1997 |
| FR | 2 701 047 A | 8/1994 |
| GB | 2 330 569 A | 4/1999 |

* cited by examiner

*Primary Examiner*—Victor Batson
(74) *Attorney, Agent, or Firm*—Stephen B. Salai, Esq.; Brian B. Shaw, Esq.; Harter, Secrest & Emery LLP

(57) ABSTRACT

The coupler has a pair of spaced side frames (25*a*) in each of which a first hook like aperture (13) is provided for engagement with a first pivot pin provided on an excavator bucket and wherein a locking pin (23) is moveable from and into a locking position in which it prevents the latching hook (17*a*) from disengage from a second pivot pin (9*a*), (9*b*) or (9*c*) on the bucket there being a plurality of locking positions for the pin to accommodate different buckets. Preferably, a plurality of spaced apertures (27), (29), (31) are formed on each of the side frames (25*a*), those in one frame being transversely aligned with those in the other frames, and preferably also a plurality of spaced apertures (33, 35) and/or latching surfaces are formed on the latching hook or on an extension thereof, through or against which the locking pin (23) can be passed or can bear to prevent relative movement between the hook (17*a*) and side frames. Preferably, the piston end cylinder device (19*a*) for operating the latching hook has a much longer stroke than usual and the side frames (25*a*) of the coupler are longer than those of known couplers, there being a downwardly opening recess (15*a*) in the side frames which is much wider than usual to accommodate different pin spacings on the buckets of different manufacturers.

28 Claims, 3 Drawing Sheets

UNIVERSAL COUPLER FOR EXCAVATOR BUCKETS

This invention relates to a universal coupler for bucket excavator.

Hydraulically operated mechanical excavators have a dipper arm on the end of which are two mounting points by means of which an excavating bucket is pivotally attached to the end of the arm, and pivoted relative to the arm, respectively. Until relatively recently, if the operator wished to change the bucket, e.g. to a larger one, this had to be done manually. This involved the operator leaving the cab of the excavator, removing two pivot pins by means of which the bucket is connected to the dipper arm, getting back into the cab to lift the dipper arm clear of the bucket, aligning the dipper arm with the new bucket (and aligning the pivot apertures), dismounting from the cab again, and locating the pivot pins in the aligned apertures, and securing them in place (e.g. with circlips, locking pins or bolts or the like) and then getting back into the cab to use the excavator. Sometimes, the operator would have considerable difficulty in removing or re-inserting the pivot pins, due to slight misalignment of the pivot apertures, and would have to use a heavy hammer for this purpose.

More recently, this time consuming exercise has been largely dispensed with, with the introduction of quick couplers which are located between the dipper arm and the bucket. The couplers can be of the mechanical type, but it is more normal now to provide a hydraulic type which can be operated from the cab of the excavator. The couplers are thus permanently fitted to the two pivot apertures of the dipper arm and the bucket pivoting link, respectively. These couplers incorporate a generally horizontally and rearwardly extending hook-like aperture or jaw adapted to engage with one of the pivot pins on the bucket (both of which are left fitted to the bucket), and a generally downwardly extending recess adapted to locate over the other pivot pin on the bucket, with which downwardly extending recess a moveable latching hook is associated.

In the manual version of the coupler, this latching hook is biased by a coil spring to its latching position, and is moved away from its latching position by a release handle or lever rod which is removably locatable in an aperture in the nose of the latching hook.

In the hydraulic version, a double acting hydraulic piston and cylinder device moves the latching hook between its respective positions, and check valves are located within the piston and cylinder device to prevent inadvertent movement of the piston in the event of hydraulic failure.

In both the manual and hydraulic versions, a safety device has to be provided. This may be a pin which must be located by the excavator operator in specially provided apertures in the coupler, to lock the latching hook in its latching position. The digger operator has to leave his cab to secure in position the safety pin. However, in U.K. Patent No. 2330570, there is a disclosure of a hydraulically operated locking means which replaces the pin. This is very satisfactory, but is an expensive option.

One of the disadvantages of these known couplers is that they have all been designed for use with one particular make of excavator, and the buckets and other tools designed for use with the excavator(s) of that make, i.e. the excavator(s) of a particular manufacturer. This means that such couplers often cannot be used to pick up a bucket or the tool of another manufacturer. This can be a substantial disadvantage, especially on sites where there may be excavators from several different manufacturers all being operated by the same contractor(s).

It is an object of the present invention to provide a universal coupler for an excavator which can be used by an excavator operator to pick up and use buckets and other tools made by different manufacturers, which may be different from the manufacturer of the excavator itself.

According to the present invention, we provide a coupler to enable an excavator operator to couple an excavator bucket to a dipper arm of an excavator while in his cab, the coupler including a pair of spaced side frames and being mountable upon or having means by means of which it can be coupled to the dipper arm of the excavator, a first hook-like aperture in each side frame for engagement with a first pivot pin provided on an excavator bucket, a power operated latching hook located between the side frames and supported for pivoting relative to the frames and operable by the operator from his cab for latching engagement with a second pivot pin provided on the bucket once the first hook-like aperture has been engaged with the first pivot pin, and a locking pin moveable from and into a locking position in which it prevents the latching hook from being disengaged from the second pivot pin on the bucket, and wherein there are a plurality of locking positions for the pin, to accommodate different buckets.

Preferably, a plurality of spaced apertures is formed in the side frames, those in one frame being transversely aligned with those in the other side frame. Preferably, also, a plurality of spaced apertures and/or latching surfaces is formed on the latching hook or an extension thereof, through which said locking pin can be passed to restrict relative movement between the hook and side frames.

Preferably, the latching hook is operated by means of a double acting piston and cylinder device, one end of which is pivotally connected about a first pivot axis relative to the coupler side frames, and the other end of which is pivotally connected to the latching hook. This piston and cylinder device has a much longer stroke than that used in known couplers. This means that the arc through which the latching hook can be pivoted is greater than on known couplers.

Furthermore, the side frames of the coupler are preferably longer than those of known couplers.

Preferably, as well as the hook-like aperture formed in each side frame, there is a recess to receive the second pivot pin on the bucket, this recess opening downwardly and at 90° to the hook-like aperture, and being substantially wider than the width of the equivalent recess on known couplers, to compensate for different pin spacings on the buckets or other tools of different manufacturers.

Although the piston and cylinder device for the latching hook is provided with a check valve and the locking means is provided, it is important that maximum provision is made to ensure that a bucket cannot accidentally become disconnected from the coupler, and preferably therefore, the latching hook is designed so that it will not rotate to a release position when under load, or when there is a hydraulic failure in the piston and cylinder device controlling the hook, and when the locking pin is not present.

In the present invention, we preferably provide a hook which has an internal profile such that under the above conditions, and when the hook is carrying the weight of the bucket, and there would otherwise be a tendency for the hook to rotate to a release position, the pin will cause the hook to swing about the pivot towards a latching position.

For this purpose, the free end of the hook has an upturned, extended nose, and the inner face of the book is of shallow V-shaped cross section, thus forming a cradle for the pin.

A preferred embodiment of coupler according to the present invention is now described by way of example with reference to the accompanying drawings, in which.

Figure 1:
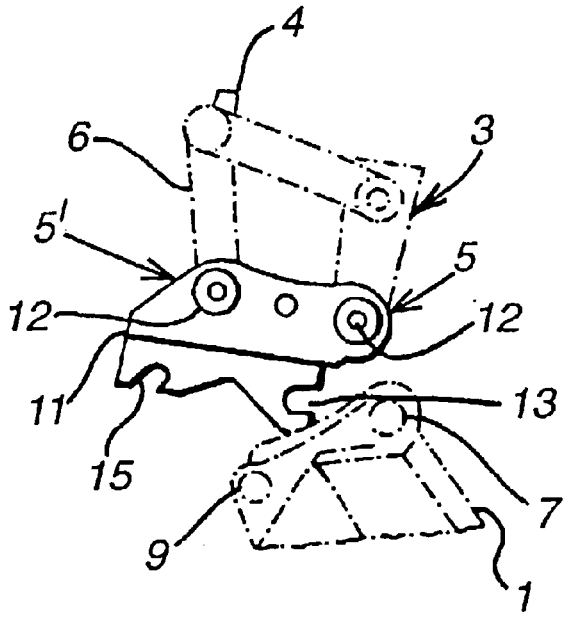
FIG. 1 (PRIOR ART)
FIG. 1 is a side elevation of a prior art coupler showing how the coupler is used to connect an excavator bucket to a dipper arm of an excavator.

Referring to FIG. 1 of the drawings, an excavator bucket is shown at 1, and the distal end of an excavator dipper arm is shown at 3. In accordance with standard practice, the dipper arm 3 supports a bucket piston and cylinder device 4 for controlling the bucket 1 via two parallel pivot links 6. The bucket 1 is normally connected directly to the dipper arm 3 by means of a first pivot pin 7 carried by the bucket and engaging directly within a mounting point or pivot aperture in an end region of the dipper arm 3 and by a second pivot pin 9 engaging directly within a mounting point or pivot aperture 5' in an end region of one of the links 6 (this arrangement is not shown).

More recently, however, a coupler 11 has been used to enable the semi-automatic connection of the bucket 1 to the dipper arm 3 and as illustrated, the coupler has two mounting points thereon by means of which it is connected to the mounting points 5 and 5' on the dipper arm 3 and on the link 6 respectively, by suitable connecting pins 12. The coupler 11 is provided in a lower region thereof with a first generally horizontally and rearwardly extending hook-like aperture or jaw 13 and a second generally downwardly opening recess or jaw 15. By rearwardly extending, we mean opening outwardly, in use, from the coupler towards the operator of an excavator on which the dipper arm and coupler are fitted and by downwardly opening we mean, in use, extending or opening outwards generally downwards towards the ground. In order to connect the bucket 1 to the dipper arm, the excavator operator manoeuvres the dipper arm to the position shown in FIG. 1 and then moves the dipper arm downwardly and rearwardly so as to engage the first aperture or jaw 13 with the first pivot pin 7, which is virtually permanently fitted to the bucket 1; he then operates the bucket-controlling piston and cylinder device 4 so as to swing the pivot links 6 downwardly, so as to move the second recess or jaw 15 into engagement with the second pivot pin 9, which is also virtually permanently secured to the bucket 1. The coupler is then latched in position with a latching hook (not shown in FIG. 1) so that the jaw 15 is clamped around the pin 9 and the bucket can be used for digging.

Figure 2:
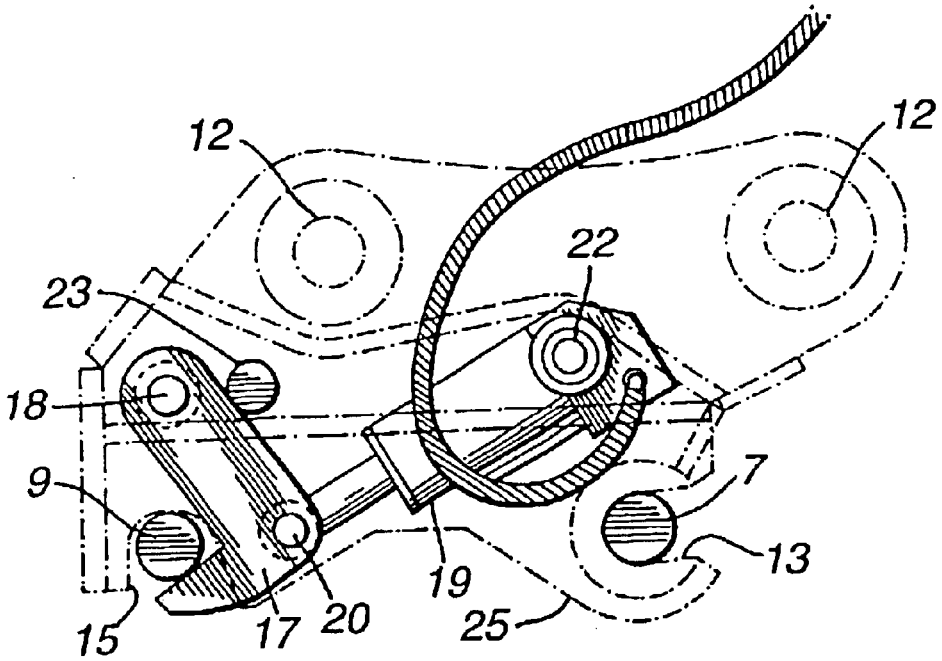
FIG. 2 (PRIOR ART)
FIG. 2 is a partly schematic side elevation to a larger scale of the coupler of FIG. 1.

In FIG. 2, a latching hook 17 forming part of the prior art coupler of FIG. 1 is shown, the hook 17 being pivotally supported on the body of the coupler about a pivot 18 and biased to a latching position (in which it maintains the pivot pin 9 in the recess 15) by means of a piston and cylinder device 19, which is of course also used to move the hook 17 to a release position. The piston of the device 19 is pivotally connected to the hook at 20 and the cylinder is pivotally connected to the body of the coupler at 22. A suitable check valve (not shown) is provided within the piston and cylinder device 19 in case there should be a failure in the hydraulic supply to the piston and cylinder device 19. However, in case this check valve should fail, a safety pin 23 is always provided. This safety pin 23 bridges between two side frame 25 of the coupler 11 and abuts against a rear face of the latching hook 17 so as to hold the latching hook 17 in a latching position and prevent the bucket pivot 9 from being released from the recess 15. The disadvantage with this arrangement is that there is very little tolerance in the spacing between the bucket pins 7 and 9. If the spacing is too great or too small, the coupler cannot be used.

Figure 3:
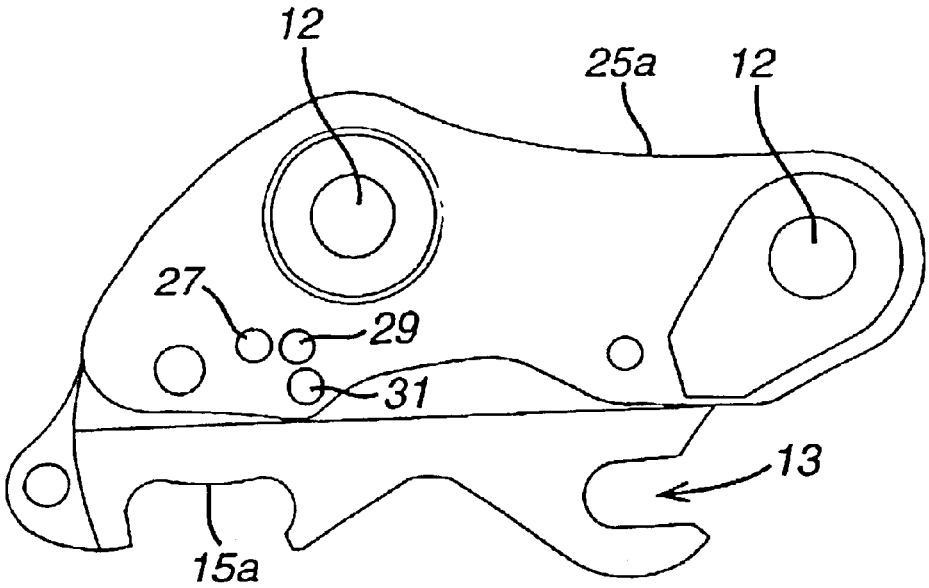
FIG. 3 is a side elevation of the coupler of the present invention.

Referring now to FIG. 3, the coupler of the invention differs from that of FIG. 2 in its overall shape and size, and general constructions of the side frames identified at 25*a*. As in the prior art construction, two mounting points are provided for connecting the coupler to the dipper arm using the pins 12, and the frames 25*a* are each provided with a first rearwardly extending hook like aperture or jaw 13 for a first bucket pin (not shown). The frames 25*a* are longer than the frames 25, and a much wider downwardly opening recess or jaw 15*a* is provided instead of the recesses 15, in each frame 25*a*. Furthermore, three closely adjacent, but spaced circular holes 27, 29 and 31 are formed in each of the frames 25*a*, so as to provide three sets of holes, the holes of each set being directly opposite one another in the respective frames 25*a*, thus providing three different locations for a locking pin 23 (see FIGS. 4–6).

Figure 4:
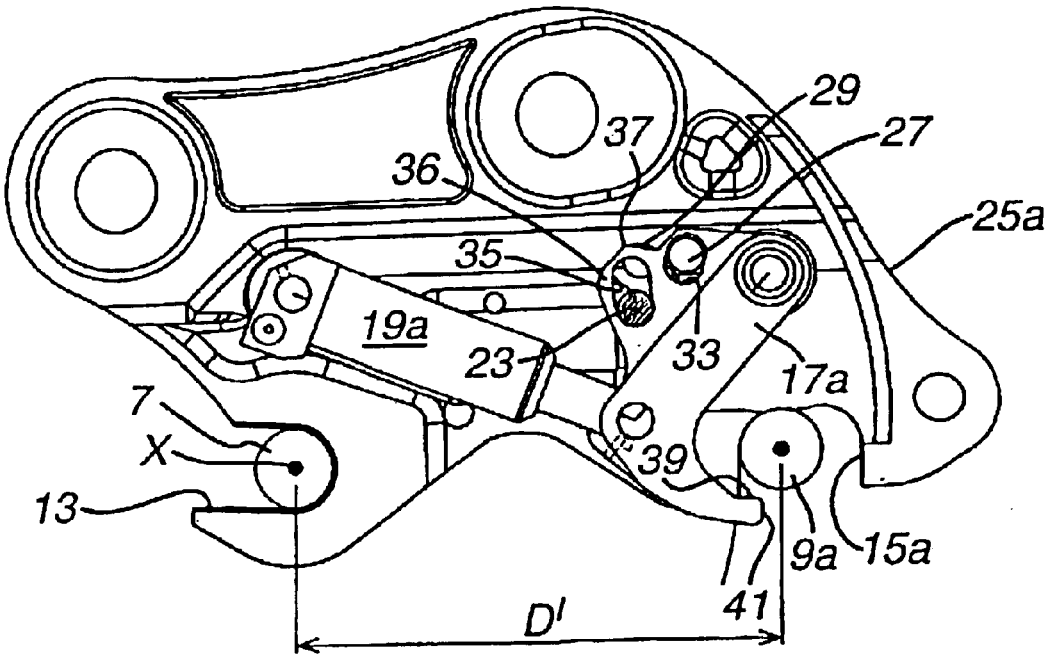
FIGS. 4–6 are partly schematic side elevations with parts broken away, showing details of the coupler of FIG. 3 being coupled to three different buckets (only the pin of the bucket being illustrated).
Figure 5:
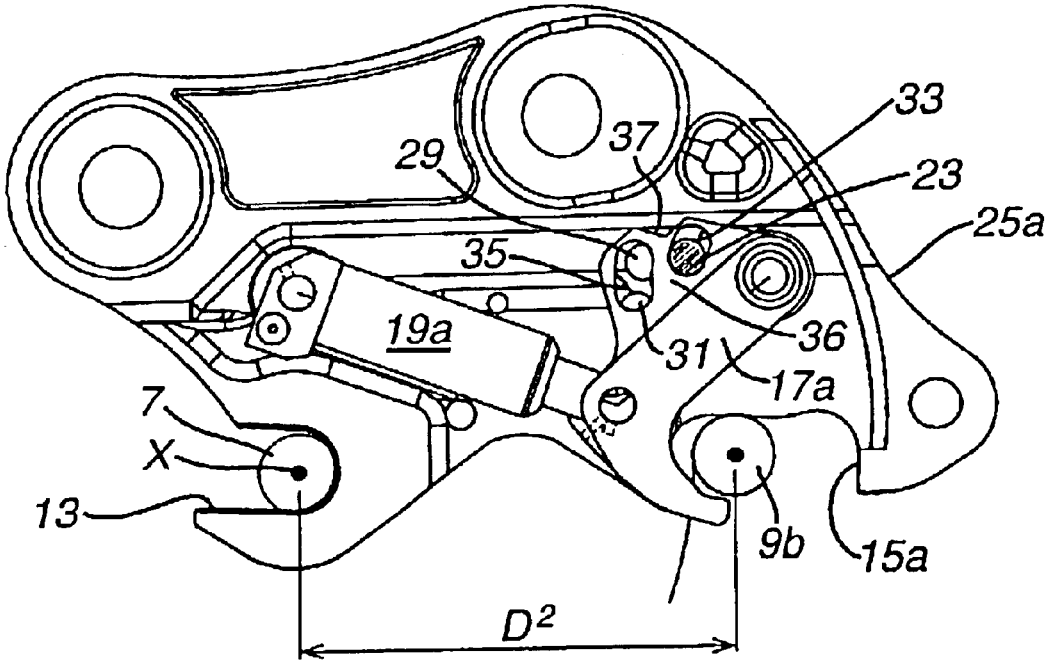
Figure 6:
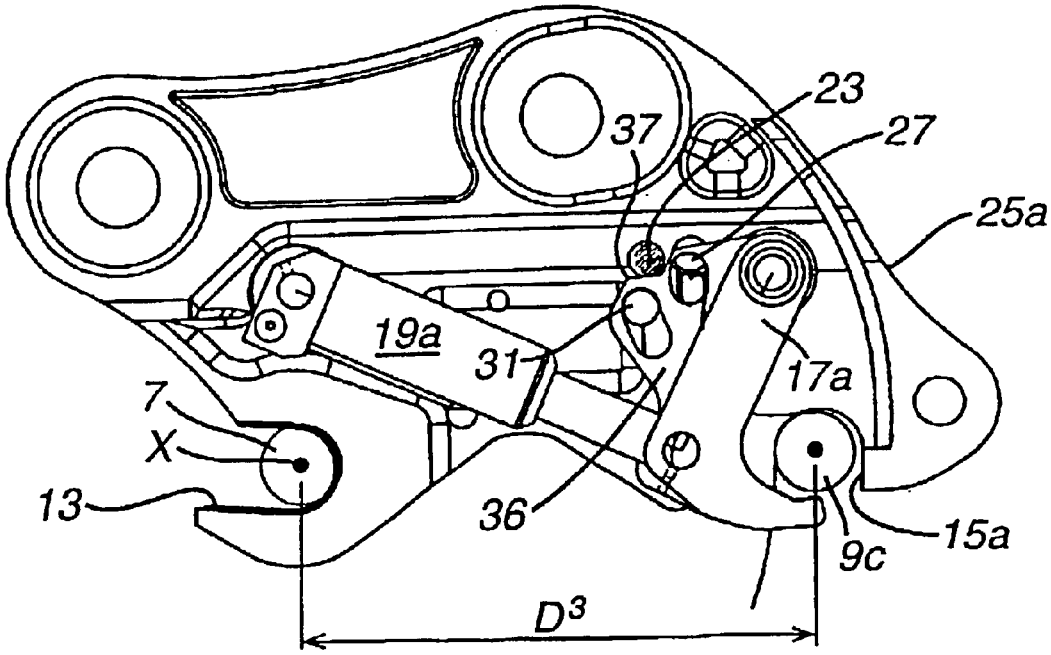

As can be seen from FIGS. 4–6, the only differences between the figures are in the locations of the bucket pins 9*a*, 9*b* and 9*c* in the recess, and in the locations of the latching hook 17*a* and of parts associated with the hook 17*a*.

Referring first to FIG. 4, the location of the central of the first pivot pin 7 of a bucket (not shown) is identified at X, when the pin is snugly received in the aperture 13. The recess 15*a* is substantially wider than the diameter of the second bucket pin 9*a*, which is shown located in a central region of the recess 15*a*. The distance between the centres of the pins 7, 9*a* is $D^1$.

As can be seen from FIG. 5, a different bucket having bucket pins 7 and 9*b*, which have their centres spaced apart by a distance $D^2$ (where $D^1>D^2$) has been picked up by the coupler.

As can be seen in FIG. 6, another different bucket having bucket pins 7 and 9*c*, has this time been picked up by the coupler. On this bucket, the spacing between the centres of the bucket pins 7 and 9*c* is $D^3$, when $D^3>D^1>D^2$.

As well as requiring a particularly wide recess 15*a* to accommodate buckets having pins with different spacings between their centres, it is necessary that the latching hook 17*a* is able to swing through different arcs to latch the respective pins 9*a*, 9*b* or 9*c* in the recess 15*a*. This is achieved by providing a piston and cylinder device 19*a* with a piston throw which is much longer than that of the piston and cylinder device 19 of the prior art coupler. This ensures that with all three (or for that matter all appropriate) bucket pin spacings, the latching hook 17*a* can be swung by an appropriate amount from a bucket release position (not shown) to a pin locking position.

As described with reference to FIG. 3, three sets of holes 27, 29, 31 for the locking pin 23 are provided in the side frames of the coupler so that, regardless of the position of the latching hook 17*a*, it can still be latched in its pin locking position.

As can be seen from each of FIGS. 4–6, the hook 17*a* has a locking plate 36 projecting from a rear portion thereof with a first locking aperture 33 therein, a second locking aperture 35 therein, and a locking surface 37 thereon. Each of the apertures 33 and 35 is of elongate arcuate construction, so as to provide a degree of universality. As can be seen from FIG. 4, for a bucket pin spacing of $D^1$, the locking pin 23 is located in the aperture 35 and passes through the holes 31 in the coupler side frames. However, in FIG. 5, where the coupler is being used with a bucket having pin spacings of $D^2$, the locking pin 23 is located in the aperture 33, and passes through the holes 27 in the side frames 25*a*. However, in FIG. 6, where the coupler has picked up a bucket with a pin central spacing of $D^3$, the locking pin 23 engages against the locking surface 37, and passes through the holes 29 in the side frames 25*a*. Hence, with all three buckets having different pin spacings, it is possible to find a set of aligned holes in the coupler side frames which are aligned with one of the apertures 33, 35 or the surface 37. It should be noted, however, that for each different pin spacing, there will only be one set of aligned holes in the coupler side frames which are aligned with one of the apertures 33, 35 or the surface 37. Hence, it is not possible to insert the locking pin 23 in a "wrong" set of holes 27, 29 or 31, and not latch the hook 17 in a pin locking position, because two of the three sets of holes 27, 29, 31 will be blocked off at any one time by the hook 17*a* or the plate 36.

In practice, there are many different manufacturers of excavators all of whom produce buckets with different pin spacings, and the coupler of the present invention, due to its universality, can be used to pick up the majority of these buckets and have its locking hook 17*a* latched in its locking position using a locking pin 23.

In spite of the safety feature described above (provision of the pin 23), there is still a slight risk, e.g. in the event of operator misuse, such as not fitting the pin 23, that the latching hook 17*a* may swing to its unlatching position, thus allowing the bucket to be dropped from the dipper arm if there is a hydraulic failure, and if the check valve in the piston and cylinder device 19 fails. Accordingly, we prefer to provide a latching hook 17*a* which, under normal conditions, cannot swing to an unlatched position, due to the weight of the bucket pivot 9 thereon.

Normally, with most prior art latching hooks, the weight of the bucket on the hook, which is transferred to the hook through the bucket pin 9, will cause the hook to swing clockwise as shown in FIGS. 4–6, due to the reaction force acting on the inner concave face of the hook, causing the hook to move to an open position. However, as is shown in FIGS. 4–6, the preferred hook of the invention has an internal profile in the form of a shallow V, as shown at 39 in FIG. 4 and an extended nose portion 41. The configuration of the internal profile is such that, when the bucket pin is bearing down upon the shallow V-shaped concave portion 39 of the hook, there will be a reaction force generated such that the moment acting on the hook 17*a* about its support pivot is anticlockwise, thus tending to move the hook to its locking position.

In the prior art coupler illustrated in FIGS. 1 and 2, the length of the cylinder 19 is about 265 mm and the length of the stroke of the cylinder is about 100 mm. This coupler could accommodate buckets (or other tools) with a pin spacing of 446 mm (between centres).

In a preferred example of coupler according to the present invention the cylinder 19*a* is about 310 mm long, and the length of its stroke is about 140 mm. Furthermore, the side frames 25*a* are about 20% longer than the side frames 25 of the prior art coupler, which means that the coupler of this invention can accommodate bucket pin spacings between about 435 mm and 520 mm. There is an increase in the length of the recess 15*a* of about 90 mm relative to the length of the prior art recess 15. The base of the recess 15*a* is slightly "humped" at a central region to ensure that a bucket pin located in the recess always sits in a same region of the hook 17*a* regardless of the bucket pin spacing. This ensures that both the stresses within the hook and the bucket clamping force remains constant.

It will of course be understood that the present invention has been described above purely by way of example, and modifications of detail can be made within the scope of the invention.

What is claimed is:

1. A coupler to enable an excavator operator to couple an excavator bucket to a dipper arm of an excavator while in his cab, the coupler including a pair of spaced side frames and being mountable upon or having means by means of which it can be coupled to the dipper arm of the excavator, a first hook-like aperture in each side frame for engagement with a first pivot pin provided on the excavator bucket, a power operated latching hook located between the side frames and supported for pivoting relative to the frames and operable by the operator from his cab for latching engagement with a second pivot pin provided on the bucket once the first hook-like aperture has been engaged with the first pivot pin, a plurality of spaced apart apertures in each side frame and a locking pin moveable from and into a plurality of locking positions in the spaced apart apertures in which it prevents the latching hook from being disengaged from the second pivot pin on the bucket.

2. A coupler according to claim 1, wherein the plurality of spaced apertures formed in one side frame are transversely aligned with those in the other side frame.

3. A coupler according to claim 1, wherein, a plurality of spaced apertures and/or latching surfaces is formed on the latching hook or on an extension thereof, through or against which said locking pin can bear to restrict relative movement between the hook and side frames.

4. A coupler according to claim 1, wherein the latching hook is operated by means of a double acting piston and cylinder device, one end of which is pivotally connected about a first pivot axis relative to the coupler side frames, and the other end of which is pivotally connected to the latching hook.

5. A coupler according to claim 1, wherein there is a recess to receive the second pivot pin on the bucket, this recess opening downwardly and at 90° to the hook-like aperture, and being sufficiently wide to compensate for different pin spacings.

6. A coupler according to claim 1, wherein the latching hook is designed so that it will not rotate to a release position when under load, or when there is a hydraulic failure in the piston and cylinder device controlling the hook, and when the locking pin is not present.

7. A coupler according to claim 6, wherein the latching hook has an internal profile such that, when the hook is carrying the weight of the bucket, the bucket will cause the hook to swing towards a latching position.

8. A coupler according to claim 6, wherein the free end of the hook has an upturned, extended nose, and the inner face of the hook is of shallow V-shaped cross section, thus forming a cradle for the pin of the bucket.

9. A coupler according to claim 2, wherein, a plurality of spaced apertures and/or latching surfaces is formed on the latching hook or on an extension thereof, through or against which said locking pin can bear to restrict relative movement between the hook and side frames.

10. A coupler according to claim 2, wherein the latching hook is operated by means of a double acting piston and cylinder device, one end of which is pivotally connected about a first pivot axis relative to the coupler side frames, and the other end of which is pivotally connected to the latching hook.

11. A coupler according to claim 3, wherein the latching hook is operated by means of a double acting piston and cylinder device, one end of which is pivotally connected about a first pivot axis relative to the coupler side frames, and the other end of which is pivotally connected to the latching hook.

12. A coupler according to claim 10, wherein the latching hook is operated by means of a double acting piston and cylinder device, one end of which is pivotally connected about a first pivot axis relative to the coupler side frames, and the other end of which is pivotally connected to the latching hook.

13. A coupler according to claim 2, wherein there is a recess to receive the second pivot pin on the bucket, this recess opening downwardly and at 90° to the hook-like aperture, and being sufficiently wide to compensate for different pin spacings.

14. A coupler according to claim 3, wherein there is a recess to receive the second pivot pin on the bucket, this recess opening downwardly and at 90° to the hook-like aperture, and being sufficiently wide to compensate for different pin spacings on the buckets.

15. A coupler according to claim 4, wherein there is a recess to receive the second pivot pin on the bucket, this recess opening downwardly and at 90° to the hook-like aperture, and being sufficiently wide to compensate for different pin spacings on the buckets.

16. A coupler according to claim 2, wherein the latching hook is designed so that it will not rotate to a release position when under load, or when there is a hydraulic failure in the piston and cylinder device controlling the hook, and when the locking pin is not present.

17. A coupler according to claim 3, wherein the latching hook is designed so that it will not rotate to a release position when under load, or when there is a hydraulic failure in the piston and cylinder device controlling the hook, and when the locking pin is not present.

18. A coupler according to claim 4, wherein the latching hook is designed so that it will not rotate to a release position when under load, or when there is a hydraulic failure in the piston and cylinder device controlling the hook, and when the locking pin is not present.

19. A coupler according to claim 5, wherein the latching hook is designed so that it will not rotate to a release position when under load, or when there is a hydraulic failure in the piston and cylinder device controlling the hook, and when the locking pin is not present.

20. A coupler according to claim 7, wherein the free end of the hook has an upturned, extended nose, and the inner face of the hook is of shallow V-shaped cross section, thus forming a cradle for the pin of the bucket.

21. A coupler to enable an excavator operator to couple an excavator bucket to a dipper arm of an excavator while in his cab, the coupler comprising:

a pair of spaced side frames and being mountable upon or having means by means of which it can be coupled to the dipper arm of the excavator, a first hook-like aperture in each side frame for engagement with a first pivot pin provided on an excavator bucket, a latching hook located between the side frames and supported for pivoting relative to the frames for latching engagement with a second pivot pin provided on the bucket once the first hook-like aperture has been engaged with the first pivot pin, and a locking pin moveable from and into a locking position in which it prevents the latching hook from being disengaged from the second pivot pin of the bucket, wherein the coupler comprises a plurality of locking positions for the pin for accommodating buckets having different pivot pin spacings, the locking positions being defined by a plurality of spaced apertures formed in the spaced side frames, those in one frame being transversely aligned with those in the other frame, wherein the locking pin, when inserted between a first pair of the spaced apertures, will be able to restrict relative movement between the hook and the side frames for a bucket having a first pivot pin spacing and wherein the locking pin, when inserted between a second pair of the spaced apertures, will be able to engage a locking surface on an outer surface of the book, or an extension thereof, to restrict relative movement between the hook and the side frames for a second, different, bucket having a second, different, pin spacing; and wherein the latching hook is power operated and operable by the operator from his cab.

22. A coupler according to claim 21, wherein a plurality of spaced apertures and the locking surface are formed in or on the hook, or an extension thereof, through or against which said locking pin can be passed or bear to restrict the relative movement between the hook and the side frames.

23. A coupler according to claim 21 wherein a plurality of spaced apertures and latching surfaces is formed on an extension of the hook, through or against which said locking pin can be passed or bear to restrict the relative movement between the hook and side frames.

24. A coupler according to claim 21 wherein the latching hook is operated by means of a double acting piston and cylinder device, one end of which is pivotally connected about a first pivot axis relative to the coupler side frames, and the other end of which is pivotally connected to the latching hook.

25. A coupler according to claim 21 wherein there is a recess to receive the second pivot pin on the bucket, this recess opening downwardly and at 90° to the hook-like aperture, and being sufficiently wide to compensate for the different pin spacings on the buckets or other tools of different manufactures.

26. A coupler according to claim 21 wherein the latching hook is designed so that it will not rotate to a release position when under load, or when there is a hydraulic failure in the piston and cylinder device controlling the hook and when the locking pin is not present.

27. A coupler according to claim 26 wherein the latching hook has an internal profile such that, when the hook is carrying the weight of the bucket, the bucket will cause the hook to swing towards a latching position.

28. A coupler according to claim 26 wherein the free end of the hook has an upturned, extended nose, and the inner face of the hook is of shallow V-shaped cross section, thus forming a cradle for the pin of the bucket.

* * * * *

UNITED STATES PATENT AND TRADEMARK OFFICE

CERTIFICATE OF CORRECTION

PATENT NO. : 6,922,926 B2
APPLICATION NO. : 10/203332
DATED : August 2, 2005
INVENTOR(S) : Gary Miller, Ronald Keith Miller and Paul Maguire It is certified that error appears in the above-identified patent and that said Letters Patent is hereby corrected as shown below:

Column 8, line 18
Replace "book"
With -- hook --

Signed and Sealed this

Thirtieth Day of January, 2007

JON W. DUDAS
*Director of the United States Patent and Trademark Office*

US006922926C1

(12) INTER PARTES REEXAMINATION CERTIFICATE (791st)

United States Patent
Miller et al.

(10) Number: US 6,922,926 C1
(45) Certificate Issued: Jan. 10, 2014

(54) UNIVERSAL COUPLER FOR EXCAVATOR BUCKETS

(75) Inventors: Gary Miller, Washington (GB); Ronald Keith Miller, Newcastle (GB); Paul Maguire, Winlaton (GB)

(73) Assignee: Miller UK Limited, Cramlington, Northumberland (GB)

Reexamination Request:
No. 95/001,443, Sep. 10, 2010

Reexamination Certificate for:

| | |
|---|---|
| Patent No.: | **6,922,926** |
| Issued: | **Aug. 2, 2005** |
| Appl. No.: | **10/203,332** |
| Filed: | **Feb. 24, 2003** |

Certificate of Correction issued Jan. 30, 2007

(21) Appl. No.: 95/001,443

(22) PCT Filed: Feb. 9, 2001

(86) PCT No.: PCT/GB01/00524

§ 371 (c)(1),
(2), (4) Date: Feb. 24, 2003

(87) PCT Pub. No.: WO01/59222

PCT Pub. Date: Aug. 16, 2001

(30) Foreign Application Priority Data

Feb. 11, 2000 (GB) ..... 0003267

(51) Int. Cl.
*E02F 3/96* (2006.01)

(52) U.S. Cl.
USPC ..... 37/468; 403/322.13; 414/723

(58) Field of Classification Search
USPC ..... 37/468; 414/723; 403/322.3
See application file for complete search history.

(56) References Cited

To view the complete listing of prior art documents cited during the proceeding for Reexamination Control Number 95/001,443, please refer to the USPTO's public Patent Application Information Retrieval (PAIR) system under the Display References tab.

*Primary Examiner* — Matthew C. Graham

(57) ABSTRACT

The coupler has a pair of spaced side frames (25a) in each of which a first hook like aperture (13) is provided for engagement with a first pivot pin provided on an excavator bucket and wherein a locking pin (23) is moveable from and into a locking position in which it prevents the latching hook (17a) from disengage from a second pivot pin (9a), (9b) or (9c) on the bucket there being a plurality of locking positions for the pin to accommodate different buckets. Preferably, a plurality of spaced apertures (27), (29), (31) are formed on each of the side frames (25a), those in one frame being transversely aligned with those in the other frames, and preferably also a plurality of spaced apertures (33, 35) and/or latching surfaces are formed on the latching hook or on an extension thereof, through or against which the locking pin (23) can be passed or can bear to prevent relative movement between the hook (17a) and side frames. Preferably, the piston end cylinder device (19a) for operating the latching hook has a much longer stroke than usual and the side frames (25a) of the coupler are longer than those of known couplers, there being a downwardly opening recess (15a) in the side frames which is much wider than usual to accommodate different pin spacings on the buckets of different manufacturers.

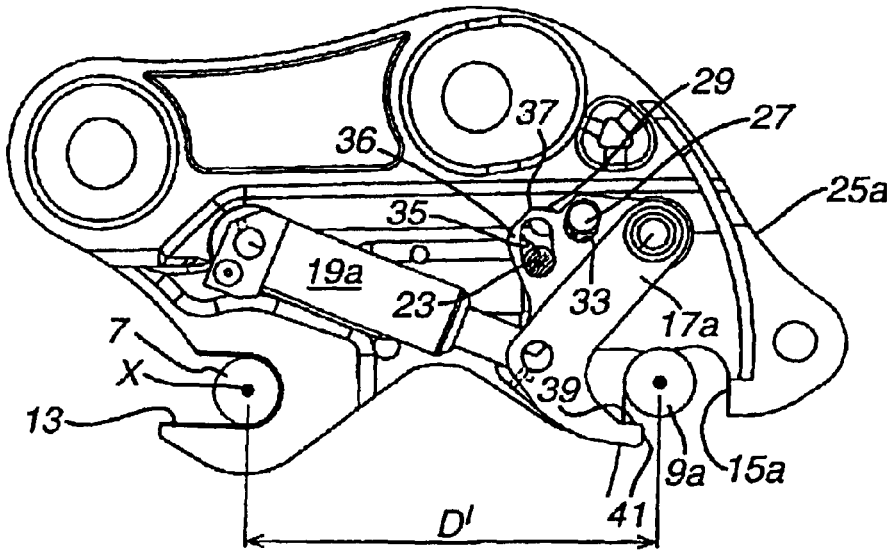

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-28 are cancelled.

New claims 29 and 30 are added and determined to be patentable.

*29. A coupler according to claim 1 in which the hook comprises an aperture of an elongate arcuate construction through which the locking pin can pass when the locking pin is inserted between the first pair of spaced apertures, whereupon relative movement between the hook and the side frames becomes restricted.*

*30. A coupler according to claim 21 in which the hook comprises an aperture of an elongate arcuate construction through which the locking pin can pass when the locking pin is inserted between the first pair of spaced apertures, whereupon relative movement between the hook and the side frames becomes restricted.*

* * * * *